US006374425B2

(12) United States Patent
Downey

(10) Patent No.: US 6,374,425 B2
(45) Date of Patent: Apr. 23, 2002

(54) SEWER SYSTEM VENTILATION CAP

(76) Inventor: Kim Downey, 2955 Arabian Dr., Park City, UT (US) 84060

( * ) Notice: Subject to any disclaimer, the term of this patent is extended or adjusted under 35 U.S.C. 154(b) by 0 days.

(21) Appl. No.: 09/861,374

(22) Filed: May 18, 2001

Related U.S. Application Data

(62) Division of application No. 09/490,751, filed on Jan. 26, 2000, now abandoned.

(51) Int. Cl.[7] ..... E03D 9/04
(52) U.S. Cl. ..... 4/218
(58) Field of Search ..... 4/210, 211, 218, 4/219, 209 FF; 454/25, 367, 368; 55/441, 505

(56) References Cited

U.S. PATENT DOCUMENTS 1,306,421 A * 6/1919 Feltz ..... 4/219 X
3,475,885 A * 11/1969 Kline ..... 4/209 FF
4,974,632 A * 12/1990 Ericson ..... 4/211 X

* cited by examiner

*Primary Examiner*—Charles E. Phillips
(74) *Attorney, Agent, or Firm*—John D. Gugliotta

(57) ABSTRACT

A durable, rotating, water-diverting, small animal and insect entry-prohibiting sewer system ventilation cap is that eliminates the influx of water into it.

1 Claim, 6 Drawing Sheets

SEWER SYSTEM VENTILATION CAP

RELATED APPLICATIONS

The present invention is a Divisional Application of U.S. application Ser. No. 09/490,751, filed on Jan. 26, 2000, and herein abandoned.

BACKGROUND OF THE INVENTION

1. Field of the Invention

The present invention relates generally to vent and baffling devices for preventing the entry of rainwater and, more particularly, to a durable, rotating, water-diverting, small animal and insect entry-prohibiting sewer system ventilation cap.

2. Description of the Related Art

Within the related art, numerous applications exist for devices consisting of vents with panels which prevent the entry of water. However, restrictions to the practical application of these devices is governed by the Uniformed Plumbing Code, which prohibits any such cap from restricting the egress of methane gas from the plumbing system.

Similarly, it is a well-known fact that a great deal of rainwater enters the sanitary sewer system during a rainfall. While a portion of this rainwater enters from improperly connected storm drain systems, some of it obviously enters via the vent system located on the roofs of homes, offices, and any structure with a sanitary sewer connection. This influx of water is then routed to the septic system or to the nearest sewage treatment plant where it must be processed along with legitimate waste water. Such large amounts of water that require treatment, especially during heavy downpours, greatly reduce the efficiency of the treatment plants and in some cases may cause the discharge of raw sewage into our lakes, rivers and streams. Over sizing of the treatment facility has been one method of dealing with this problem in the past, but this leads to inefficiencies in the plant design and causes the waste of taxpayer dollars. Additionally, in areas where developments are taking place, expansions or new treatment facilities must be added just so surges when it rains can be handled. Finally, some locations have resorted to enforcement of criminal sanctions through inspections, both physical and robotic, for the purposes of identifying, preventing, or deterring illegal dumping or other intrusion of otherwise clean rain runoff into treatments streams.

Accordingly, there exists a need for a means by which rainwater and other undesirables can be kept from entering sanitary sewer systems by way of roof vent openings.

In the related art, the following patents disclose a vent and baffle unit to provide an air passage to an attic. These include U.S. Pat. No. 4,269,007 issued in the name of Ward, U.S. Pat. No. 4,214,510 issued in the name of Ward, and U.S. Pat. No. 4,125,971 issued in the name of Ward.

U.S. Pat. No. 5,830,059 issued in the name of Sells describes a ventilating cap for a roof including a cover, a baffle, batts, or foam rubber blocks.

U.S. Pat. No. 5,655,964 issued in the name of Rheault discloses a static ventilator with louvers, a triangular base, and a cap for preventing anything from falling into it.

U.S. Pat. No. 5,549,513 issued in the name of Thomas et al. describes a roof structure with a ventilation device and a plurality of baffles for preventing the entry of rainwater.

U.S. Pat. No. 5,421,776 issued in the name of Sakamoto et al. discloses an exhaust air hood for reducing backflows.

U.S. Pat. No. 5,201,879 issued in the name of Steele describes a vent for enclosures that prevents the entry of water.

U.S. Pat. No. 4,899,647 issued in the name of Garries et al. discloses a ventilator system including an exterior panel and an interior baffle to prevent water from draining into it.

While ventilating cap and static ventilator devices are incorporated into this invention in combination, other elements are different enough as to make the combination distinguished over this related art.

Consequently, a need has therefore been felt for an improved but less complex mechanism that keeps rainwater out of sanitary sewer systems thereby reducing the loading on water treatment facilities and reducing pollution.

SUMMARY OF THE INVENTION

It is therefore an object of the present invention to provide an improved sewer system ventilation cap.

It is a feature of the present invention to prevent the entry of rainwater into sanitary sewer systems thereby reducing the loading on water treatment facilities.

It is another feature of the present invention to prevent undesirables such as small animals, birds, insects and the like from entering the system.

Briefly described according to the preferred embodiment of the present invention, a durable, rotating, water-diverting, small animal and insect entry-prohibiting sewer system ventilation cap is disclosed, comprising a hollow main chamber forming a 90° angle having an anterior end, a posterior end, and an upper portion. The upper portion of the main chamber is designed such that it measures 45°. The 45° angle design prevents the entry of water through the main chamber. A screen of wire mesh is disposed within the interior of the anterior end of the main chamber to prevent the penetration of physical debris or particulates into the sewer system ventilation cap.

The posterior end is designed so as to slidably receive a secondary chamber of a generally linearly elongated tubular configuration. The secondary chamber comprises a first end and a second end. The first end slidably engages the posterior end of the main chamber in such a way to allow the main chamber to rotate 360° around the secondary chamber when confronted by wind or storms. The main chamber's ability to rotate 360° allows for the evacuation of sewer gases, allows proper ventilation and prevents the entry of rain water through the main chamber. The warmth of the sewer gas prevents the main chamber from freezing.

The lower end of the secondary chamber is connected to a plumbing vent of a conventional sewer system.

In accordance with a preferred embodiment, a ventilation cap having grill work with a cover over the grill work is envisioned. The cover is of a dome-like configuration having a diameter so as to effectively shield the plumbing vent from the entry of rainwater and simultaneously allowing the sewer gases to vent. The grill work is comprised of several grill members of a linearly elongated rectangular configuration having a front end and a back end. The front ends of the grill members are coupled to the underneath portion of the cover and are collectively aligned so as to form a circular configuration. The back ends of the grill members are attached to the plumbing vent of a conventional sewer system.

In another preferred embodiment of the present invention, a sewer system ventilation cap having baffles, drain holes, and an interior lip is envisioned. The baffles are of an elongated oval shape defining a hole therethrough and are located along the external circumferential surface of the sewer system ventilation cap. The baffles allow for the evacuation of sewer gases and allows the system to vent properly. The interior lip is located at the base and inside of the sewer system ventilation cap. Drain holes rest along the interior lip so as to allow the exit of any rainwater that has entered.

An advantage of the present invention is that it conserves natural resources and reduces pollution.

Another advantage of the present invention is the savings in time and manhours represented by the decreased water throughput required by a wastewater treatment systems that can be achieved if a significant number of structures incorporate the teachings of the present invention.

Yet another advantage of the present invention is that it postpones the expansion of existing sewer treatment facilities or prevents the construction of new sewer treatment facilities, in turn saving tax dollars.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
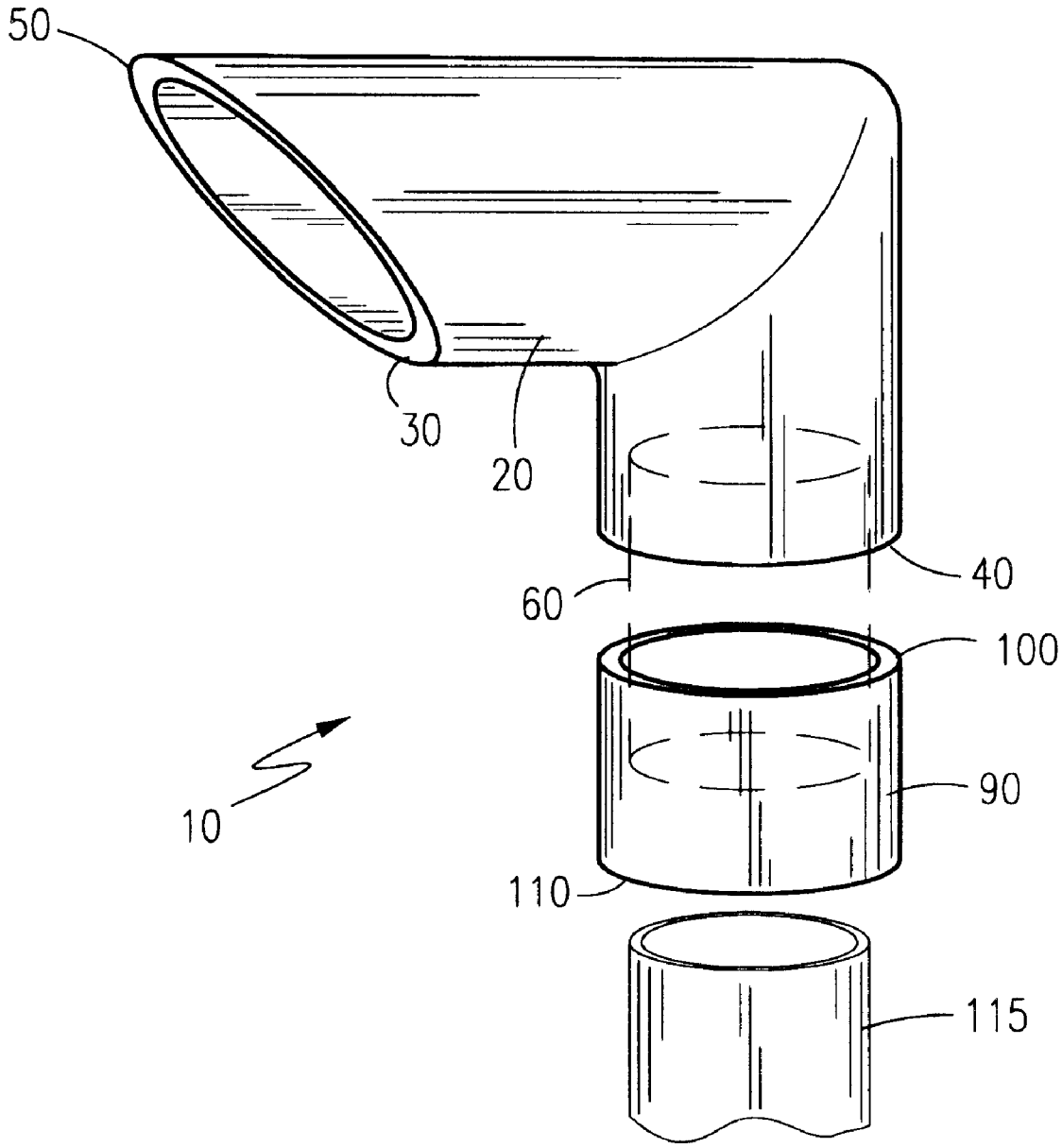
FIG. 1 is an exploded perspective view of the preferred embodiment of a durable, rotating, water-diverting, small animal and insect entry prohibiting sewer system ventilation cap.
Figure 2:
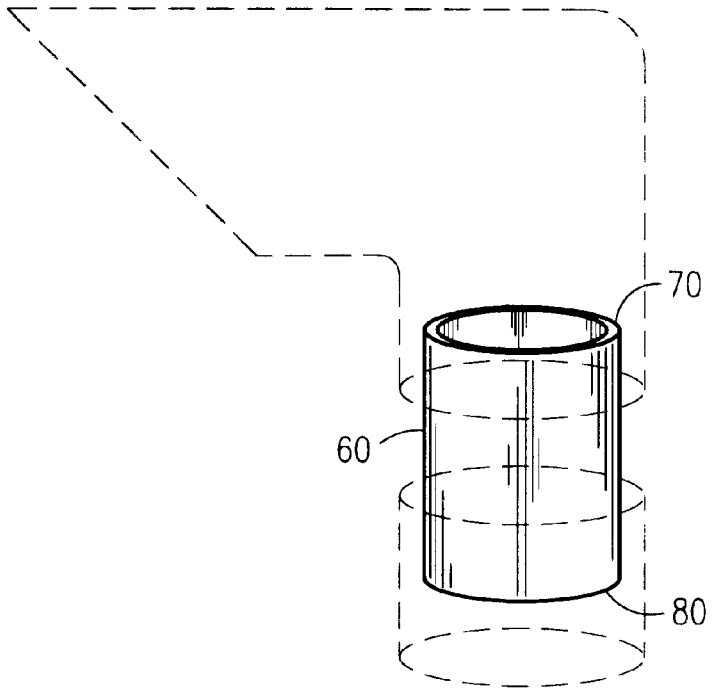
FIG. 2 is a internal sectional view thereof.
Figure 3:
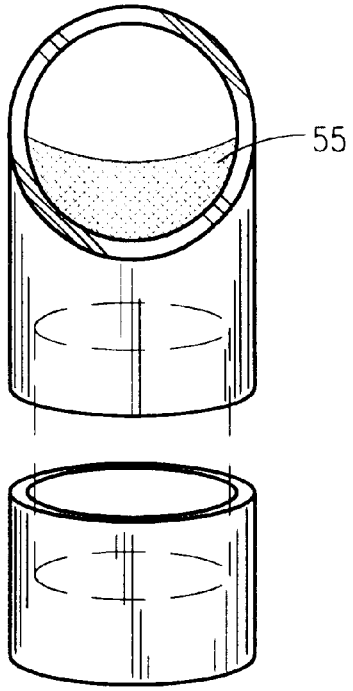
FIG. 3 is a front elevational view thereof.

Referring now to FIG. 1–3, a durable, rotating, water-diverting, small animal and insect entry-prohibiting sewer system ventilation cap 10 is disclosed, comprising a hollow main chamber 20 forming a generally perpendicular angle, shown herein as 90° having an anterior end 30, a posterior end 40, and an upper portion 50. The upper portion 50 of the main chamber 20 is designed such that it measures 45°. The 45° angle design prevents the entry of water through the main chamber 20. A screen 55 of wire mesh is disposed within the interior of the anterior end 30 of the main chamber 20 to prevent the penetration of small animals and insects into the sewer system ventilation cap 10.

The posterior end 40 is designed so as to slidably receive a secondary chamber 60 of a generally linearly elongated tubular configuration. The secondary chamber 60 comprises a first end 70 and a second end 80. The first end 70 slidably engages the posterior end 40 of the main chamber 20 in such a way to allow the main chamber 20 to rotate 360° around the secondary chamber 60 when confronted by wind or storms. The main chambers 20 ability to rotate 360° allows for the evacuation of sewer gases, allows proper ventilation and prevents the entry of rain water through the main chamber 20. The warmth of the sewer gas prevents the main chamber 20 from freezing.

The sewer system ventilation cap 10 further comprises a tertiary chamber 90 of a linearly elongated, hollow cylindrical configuration, having an upper end 100, and a lower end 110. The tertiary chamber 90 is designed so as to slidably receive the second end 80 of the secondary chamber 60 such that the second end 80 of the secondary chamber 60 and the upper end 100 of the tertiary chamber 90 become locked into position.

The lower end 110 of the tertiary chamber 90 is connected to a plumbing vent of a conventional sewer system.

Figure 4:
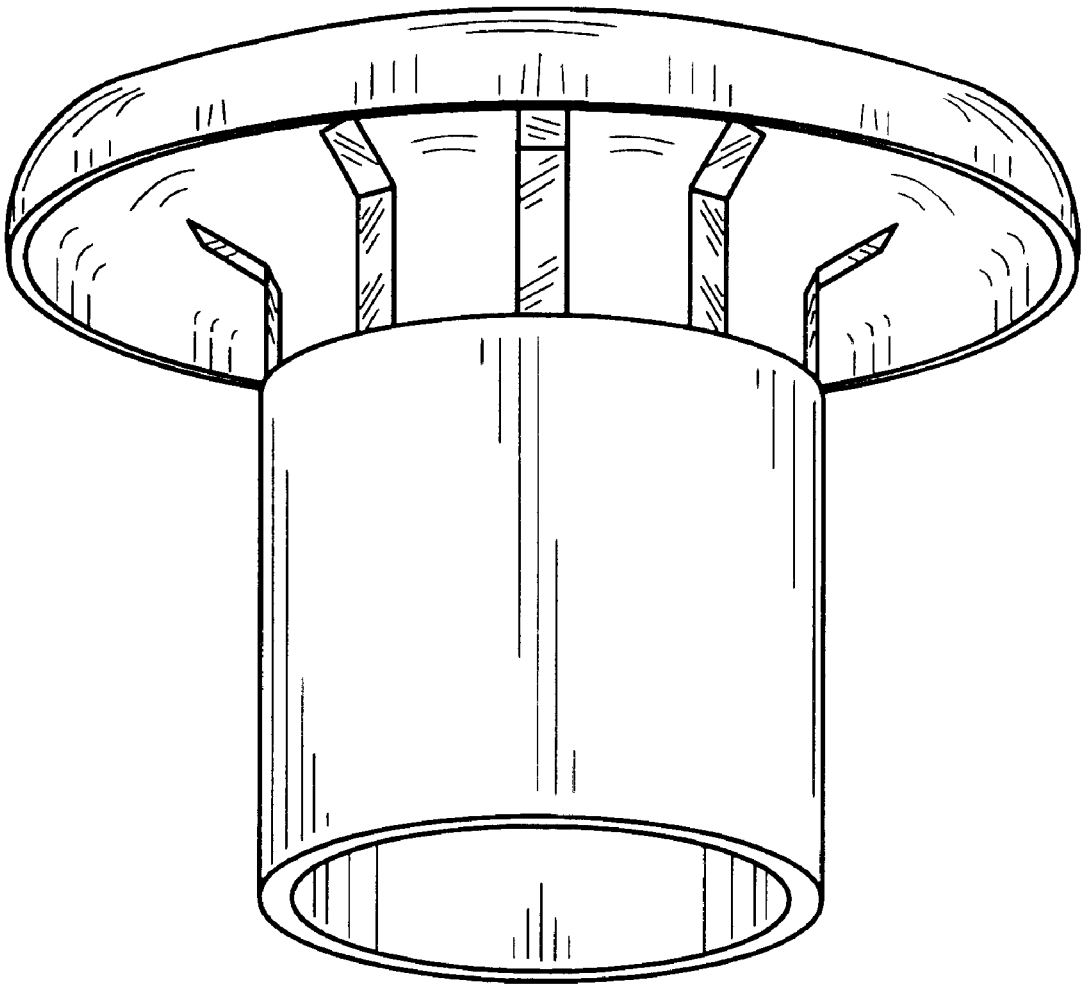
FIG. 4 is a perspective view of a first alternate embodiment of a water-diverting, small animal and insect entry prohibiting sewer system ventilation cap.

In accordance with a first alternate embodiment as shown in FIG. 4, a sewer system ventilation cap 10 comprising grill work 120 with a cover 130 over the grill work 120 is envisioned. The cover 130 is of a dome-like configuration having a diameter so as to effectively shield the plumbing vent 115 from the entry of rainwater and simultaneously allowing the sewer gases to vent. The grill work 120 is comprised of several grill members 140 of a linearly elongated rectangular configuration having a front end 150 and a back end 160. The front ends 150 of the grill members 150 are coupled to the underneath portion of the cover 130 and are collectively aligned so as to form a circular configuration. The back ends 160 of the grill members 140 are attached to the plumbing vent 115 of a conventional sewer system.

Figure 5:
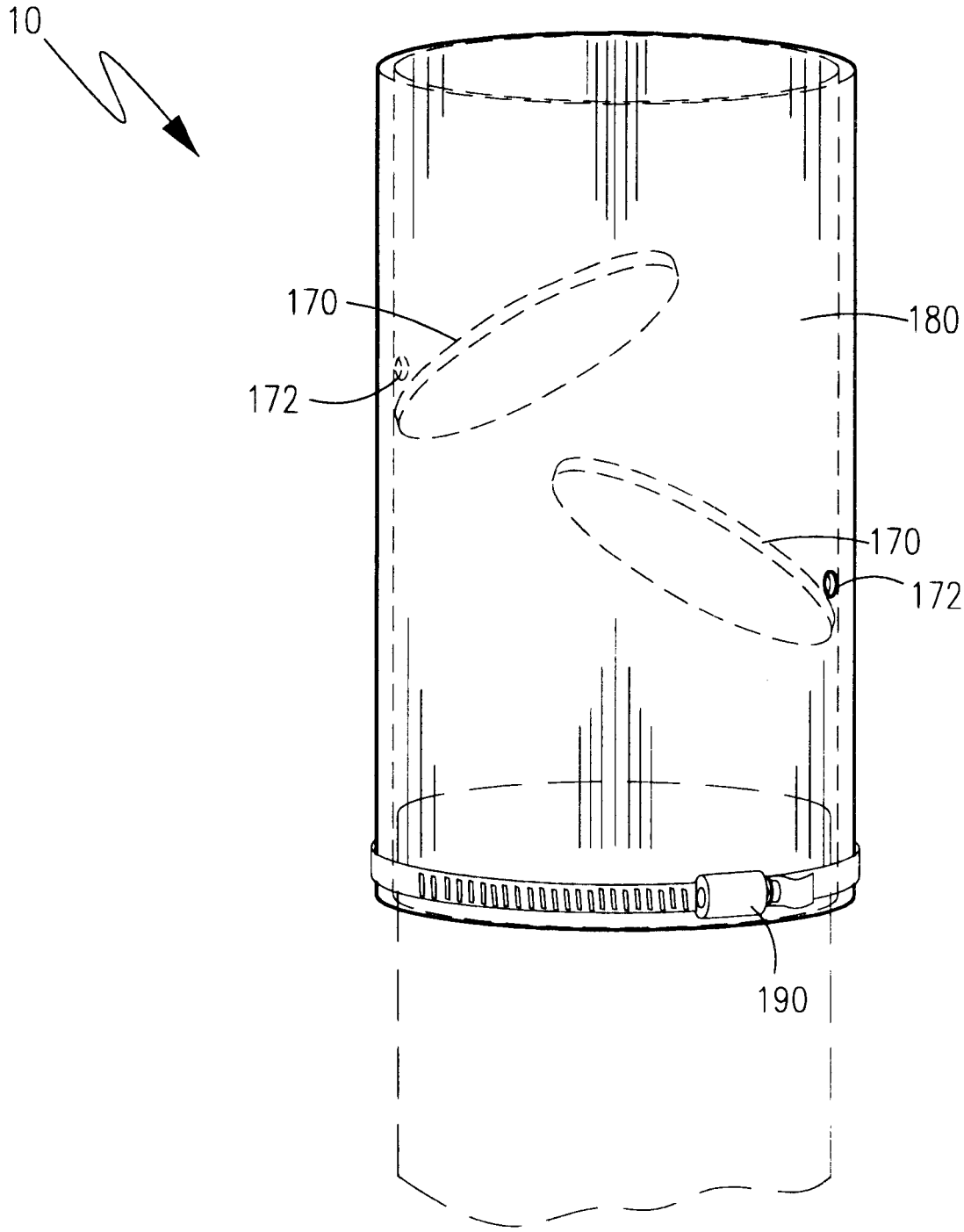
FIG. 5 is a perspective view of a second alternate embodiment thereof.

In a second alternate embodiment of the present invention as shown in FIG. 5, a sewer system ventilation cap 10 comprising baffles 170 within a tubular sidewall 180. It is envisioned that the tubular sidewall 180 is attached to a vent via a clamp 190, or in any other conventional manner. The baffles 170 are of an elongated oval shape and are located along the external circumferential surface of the sewer system ventilation cap 10. The baffles 170 allow for the evacuation of sewer gases and allows the system to vent properly while forcing entering fluid against the sidewall. Formed by the outer sidewall 180 are a series of drain orifices 172 located near the lower "V" shaped attachment point between the sidewall and the baffle so as to effectively drain outward any rainwater that has entered.

Figure 6:
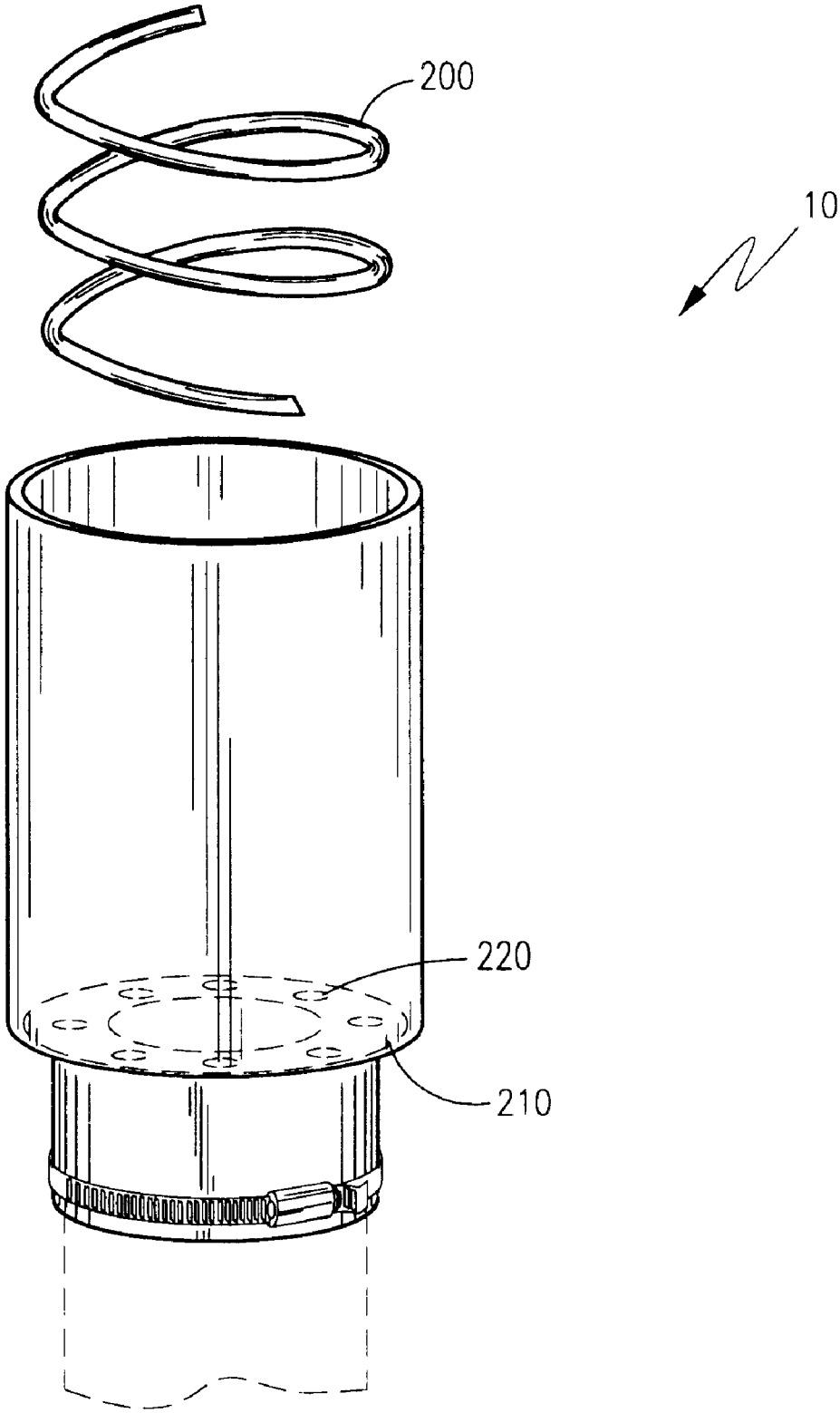
FIG. 6 is an exploded perspective view of a third alternate embodiment thereof.
Figure 7:
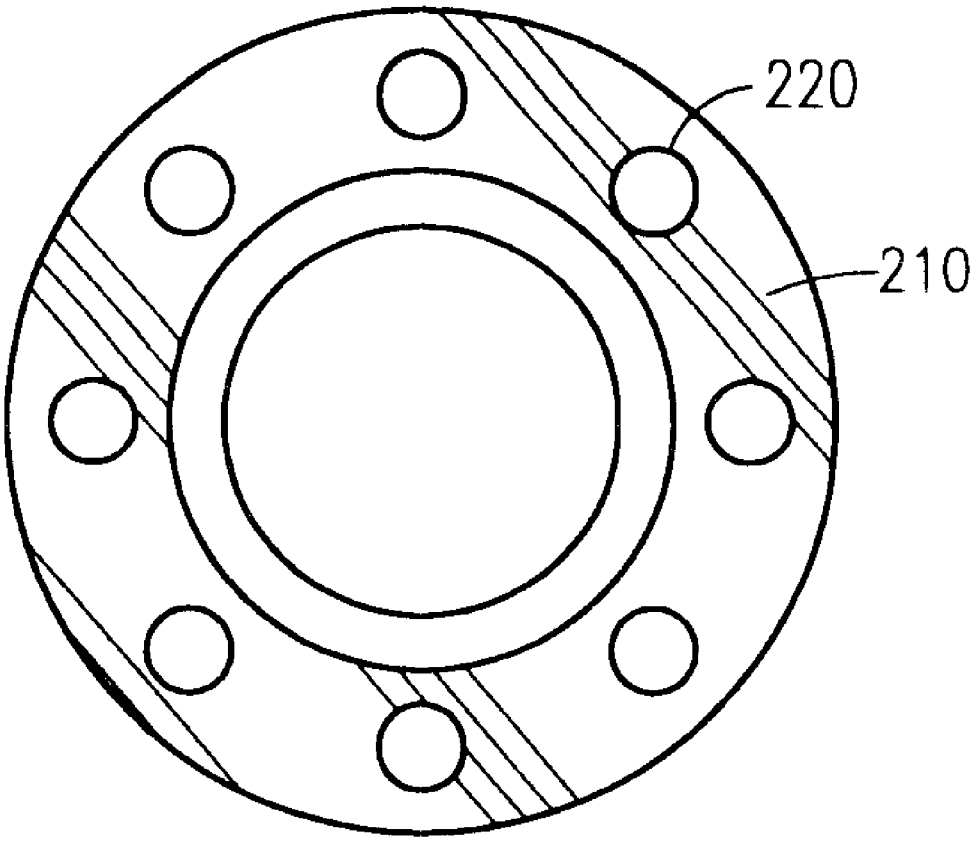
FIG. 7 is a bottom plan view thereof.

Finally, FIG. 6 depicts a sewer system ventilation cap 10 comprising a helical baffle 200 that is attached to the inside sidewall and winds downward to an interior lip 210. Drain holes 220 are formed within the interior lip 210. The baffle 200 is located along the external circumferential surface of the sewer system ventilation cap 10. The baffle 210 allows for the evacuation of sewer gases and allows the system to vent properly, while at the same time guiding any intruding fluids downward to the lip 210 and holes 220.

2. Operation of the Preferred Embodiment

In operation, the present invention is designed to prevent the entrance of rainwater and other undesirables into the sanitary sewer waste stream. It is envisioned that the invention would be made of PVC plastic for use on residential installations and be made of copper or cast iron for commercial and industrial installations. Aluminum or galvanized steel, made into a cap using stamping techniques could also be used as well. With the reduction of rain water entering the sanitary sewer system, there is a corresponding decrease in the amount of water that needs to be processed at the local water treatment plant. Such decreases at the water treatment plants results in better operating efficiency and fewer pollutants in our lakes, rivers, and streams. The use of the present invention allows for the reduction of rainwater in our sanitary sewer system while allowing the sewer vent to perform all its functions without interference.

The foregoing description is included to illustrate the operation of the preferred embodiment and is not meant to limit the scope of the invention. It would be anticipated that one skilled in the relevant art, in combination with the technology disclosed herein, could use the present teachings to accomplish the functionality described herein. Therefore, the scope of the invention is to be limited only by the following claims.

What is claimed is:

1. A sewer system ventilation cap comprising:

a cylindrical vent tube having an inside sidewall forming an interior circumferential surface and forming a lower interior lip;

a helical baffle attached to said inside sidewall and winds downward toward said lower interior lip; and drain holes, said drain holes formed within said interior lip;

and wherein said helical baffle is located along said internal circumferential surface, thereby allowing for the evacuation of sewer gases while simultaneously guiding any intruding fluids downward to said lip and out said holes.

* * * * *